US005094471A

United States Patent [19]

Luschnig et al.

[11] Patent Number: 5,094,471

[45] Date of Patent: Mar. 10, 1992

[54] HEEL HOLDER

[75] Inventors: Franz Luschnig, Traiskirchen; Karl Stritzl, Vienna; Roland Erdei, Weigelsdorf; Hubert Wuerthner, Hainburg/Donau, all of Austria

[73] Assignee: TMC Corporation, Baar, Switzerland

[21] Appl. No.: 553,809

[22] Filed: Jul. 13, 1990

[30] Foreign Application Priority Data

Jul. 13, 1989 [AT] Austria ..... 1695/89

[51] Int. Cl.[5] ..... A63C 9/084

[52] U.S. Cl. ..... 280/628; 280/634

[58] Field of Search ..... 280/623, 626, 627, 628, 280/629, 630, 631, 633, 634

[56] References Cited

FOREIGN PATENT DOCUMENTS 380174 4/1986 Austria .
383498 7/1987 Austria .
386749 10/1988 Austria .
2200768 7/1972 Fed. Rep. of Germany .

*Primary Examiner*—Andres Kashmikow
*Assistant Examiner*—Richard Camby
*Attorney, Agent, or Firm*—Flynn, Thiel, Boutell & Tanis

[57] ABSTRACT

A heel holder including a base plate on which is arranged a bearing block which can be pivoted laterally. A swivel head is supported in the bearing block on a transverse axle. Between the base plate and the bearing block there is provided a return spring. A locking mechanism is provided in addition, which locking mechanism holds the bearing block in its centered position. In order to hold the bearing block in the heel holder with pressure, the invention provides that the base plate carries a rectangular projection on its upper side, with which projection is associated a recess in the base of the bearing block, and that above the projection there is arranged the locking mechanism which acts through a frictional connection.

11 Claims, 4 Drawing Sheets

HEEL HOLDER

FIELD OF THE INVENTION

The invention relates to a heel holder for use on a ski binding adapted to be mounted on a ski.

BACKGROUND OF THE INVENTION

Such a heel holder is for example described in AT-B-383 498. The return of the bearing block into its center position relative to the base plate is in this heel holder accomplished by a torsion spring, the two legs of which each have one bent end area extending in direction toward the upper side of the ski. The two end areas are received in a recess constructed at the rear end of the base plate.

In a simple design of this heel holder, a locking of the heel holder in the center position of the bearing block is done by a resilient tongue, which is forked at its end and which is arranged in the base of the bearing block, is controlled by the locking rocker arm and is supported in the locked position on a projection of the base plate. In order to prevent with this tongue, during stepping in, a lateral swinging out of the bearing block even during a constant lateral load, this design, however, demands high manufacturing exactness since the position, in which the locking rocker arm grips under the locking nose, must coincide exactly with the position in which the tongue leaves the projection.

In other designs of such a heel holder (see FIGS. 7–15 and AT-B-386 749), the disclosed disadvantage does not occur, however, these designs are slightly complicated in their construction due to the leverlike locking element, which is under the action of a spring and which is pivotally supported in the bearing block. Furthermore, the heel holder can in both cases be pivoted only when the sole down-holding means is open. Furthermore, the bringing into existence of the diagonal control is complicated in this heel holder because an upward pivoting of the sole down-holding means, which pivoting is too intensive, leads immediately to the locking of the resilient tongue and thus stops a lateral swinging out of the heel holder. This is the result of designing the locking mechanism with forced locking.

A further heel holder is shown in AT-B-380 174. This heel holder belongs to a different class than the subject matter of the invention because an additional elastic locking mechanism, which holds the bearing block in its center position when the ski boot steps in, is missing here.

The heel holder described in the DE-A-22 00 768 differs also with respect to its class from the subject matter of the invention. Thus, the heel holder does not have a swivel head, but a housing-like heel-holding member. A stepping spur does not exist. The sole down-holding means is rotated around a vertical screw bolt during a twisting fall. A stop loaded by the release spring and secured on the sole down-holding means is thereby pivoted, which stop is supported on a counter-stop of a carriage carrying the heel holder. An additional elastic locking mechanism is also missing in this design.

SUMMARY OF THE INVENTION

The purpose of the invention is to avoid the disadvantages of the known designs and to provide a heel holder, the mounting of which in the centered position (down-hill skiing position or stepping-in position) is done by means of a pressure locking mechanism.

In contrast to the known locking mechanisms, which operate with a forced locking, the controlled diagonal release of a heel holder equipped with a locking mechanism of the invention can also be carried out by untrained persons. Regardless of this, this locking mechanism guarantees a centered position of the heel holder for the stepping in also on difficult terrain.

The stiffness of the insert is increased by the inventive features of this invention so that the insert can be manufactured of a thinner material.

The leaf spring feature for the elastic locking mechanism makes the manufacture of the locking mechanism out of a band material and its anchoring on the insert easier.

BRIEF DESCRIPTION OF THE DRAWINGS

Exemplary embodiments of the subject matter of the invention are illustrated in the drawings, in which.

DETAILED DESCRIPTION

Figure 1:
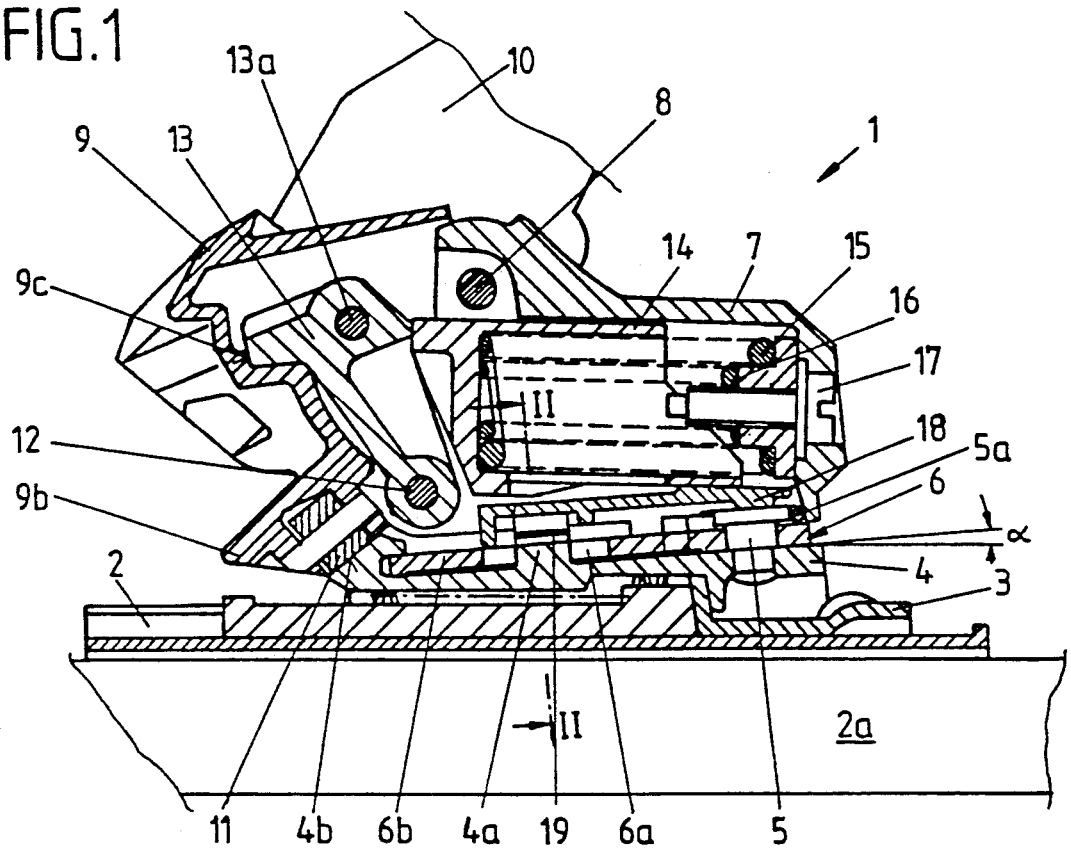
FIG. 1 is a vertical longitudinal center cross-sectional view of a first heel holder of the invention in the skiing position.

The heel holder according to FIG. 1 is identified in its entirety by the reference numeral 1. The heel holder is movably guided on a rail 2 which is fastened on the upper side of a ski 2*a* by means of screws (not illustrated), and can be locked by means of a detent 3 which is received in at least one recess of the rail 2. The heel holder 1 can in this manner be adjusted to various boot sizes.

The heel holder 1 consists of a base plate 4 mounted to slide along the rail 2. The heel holder has an axle 5 thereon which is perpendicular with respect to the base plate 4. A bearing block 6 is pivotally supported on the axle and is urged into a centered position by a torsion spring 5*a*. The base plate 4 has an upwardly directed projection 4*a*, with which is associated a recess 6*a* in the base 6*b* of the bearing block 6.

The upwardly facing side of the base plate 4 defines with its downwardly facing side a rearwardly opening acute angle $\alpha$. This inclined position of the heel holder 1 balances the embossing on the ski existing in the binding area such that the inserted ski boot lies with its sole substantially in a plane parallel to the running surface of the ski.

A binding housing 7 is fastened on the bearing block 6. The binding housing 7 carries at its front end on a transversely extending axle 8 a swivel head 9 having sole down-holding means 9*a* and a stepping spur 9*b* thereon. A roller 11 is supported in the spur 96, which roller rests on a control cam 4*b* on the base plate 4. A locking rocker arm 13 is supported in the bearing block 6 on a further transversely extending axle 12, which locking rocker arm 13 rests on a control cam surface 9*c* arranged on the inside of the swivel head 9. The locking rocker arm 13 is loaded by a piston 14 urged by two coaxial pressure springs 15, 16 supported in the binding housing 7, the initial tension of which pressure springs can be adjusted by means of an adjusting screw 17. A plate-shaped insert 18 of plastic is fastened on the inside of the bearing block 6, which insert extends parallel with respect to the base 6*b* of the bearing block. The insert 18 has in the area of its longitudinal sides downwardly projecting edges $18a_1$, $18a_2$. A leaf spring 19 acting as a detent is arranged between the insert 18 and the projection 4*a* of the base plate 4, which projection is rectangular in cross section.

A hand lever 10, which is only partially illustrated, is mounted in a conventional manner on a cross-bolt 13*a* of the locking rocker arm 13 to facilitate a voluntary opening of the heel holder 1.

Figure 2:
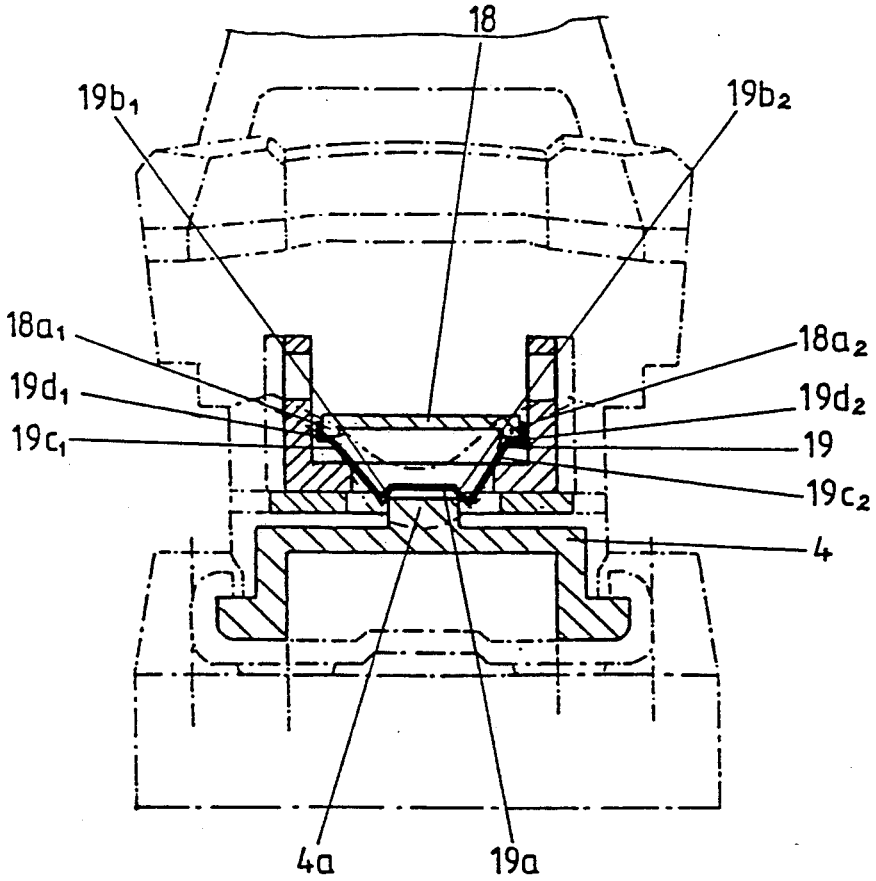
FIG. 2 is a cross-sectional view taken along the line II—II of FIG. 1 of a detail of the heel holder.

The leaf spring 19 is—viewed in longitudinal direction—approximately W-shaped according to FIG. 2. It has a horizontal center part 19*a*, two downwardly bent legs $19b_1$, $19b_2$ contiguous with the center part, and two further upwardly bent legs $19c_1$, $19c_2$ contiguous with the legs $19b_1$, $19b_2$. The ends of the legs $19c_1$, $19c_2$ are again bent at $19d_1$, $19d_2$ and rest on the undersides and on the side surfaces of the two edges $18a_1$, $18a_2$.

Figure 2A:
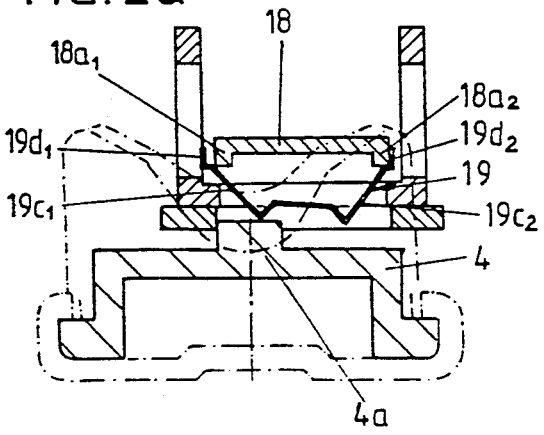
FIG. 2*a* illustrates the same detail in the swung-out position of the heel holder.

The leaf spring 19 is in the skiing position in the position illustrated in FIG. 2. If the bearing block 6 is, however, pivoted relative to the base plate 4 (see FIG. 2*a*), then the one lower side of the leaf spring 19 is pressed upwardly, for which first a relatively large force is needed, which, however, decreases as soon as the pressed-back lower side rests on the upper side of the projection 4*a* of the base plate 4. The bearing block 6 is pivoted from this time on only yet against the friction force occurring between the leaf spring 19 and the base plate 4 or rather its projection 4*a*.

Figure 2B:
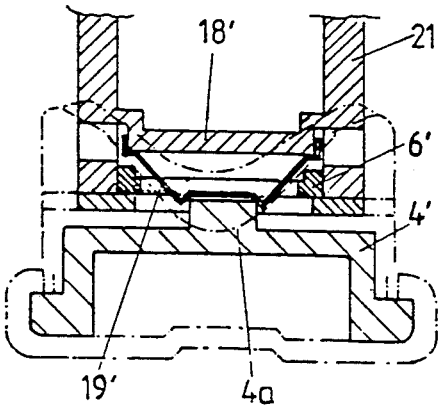
FIG. 2*b* shows a modification of the embodiment according to FIGS. 1 and 2.

The modified embodiment according to FIG. 2*b* differs from the one first described in that a bearing block 6', which is supported pivotally on a vertical axle of the base plate 4', is constructed relatively flat and has two shoulders at its rear end, with which shoulders it is received in recesses in the crosswall of a housing 21, which for strength reasons is preferably manufactured of aluminum.

The bearing block 6' has two bearing holes at its front end aligned in an assembled state with two bearing holes of the housing 21. A bolt extends through both sets of bearing holes. The housing 21 has in the place of a platelike insert of plastic a crossbar 18' constructed in one piece with the housing 21. The crossbar 18' serves to support a leaf spring 19', which corresponds with the leaf spring of the first exemplary embodiment.

Figure 3:
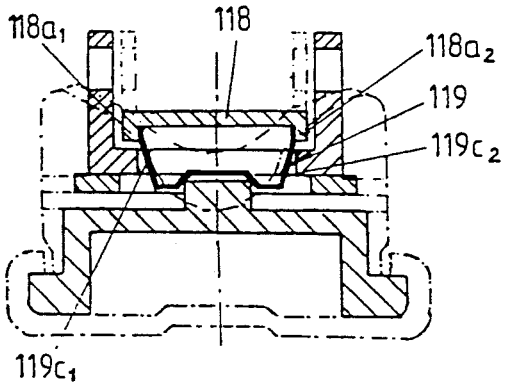
FIGS. 3 to 13 are cross-sectional views of modifications of the embodiment according to FIGS. 1 and 2.

The leaf spring 119 illustrated in FIG. 3 is similar to the one first described. It differs from the first embodiment only in the ends of the legs $119c_1$, $119c_2$ being bent inwardly at an obtuse angle and resting on the inner sides of the two edges $118a_1$, $118a_2$ of the insert 118, corresponding to the insert 18 in FIGS. 1 and 2.

Figure 4:
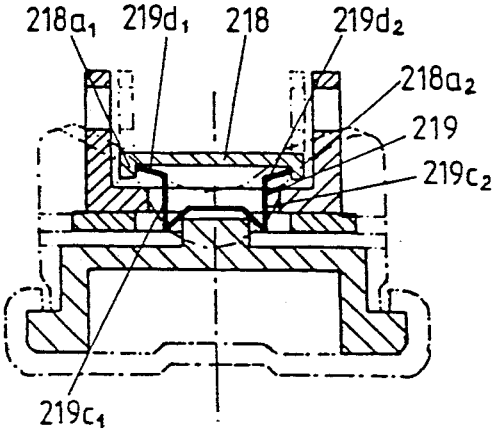

The legs $218c_1$, $219c_2$ are in the case of the leaf spring 219 according to FIG. 4 bent outwardly at their ends $219d_1$, $219d_2$ and are received in the recessed borders between the edges $218a_1$, $218a_2$ and the insert 218, corresponding to the insert 18 in FIGS. 1 and 2.

Figure 5:
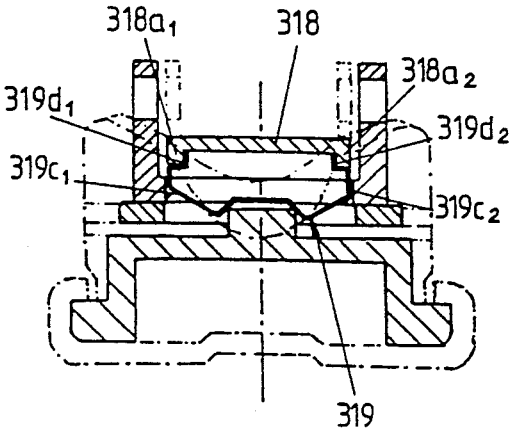

The design of a leaf spring 319 illustrated in FIG. 5 is similar to the one described first with the only difference being that the ends $319d_1$, $319d_2$ of the two legs $319c_1$, $319c_2$ rest on the undersides and on the inner sides of the two edges $318a_1$, $318a_2$ of the insert 318, corresponding to the insert 18 in FIGS. 1 and 2.

Figure 6:
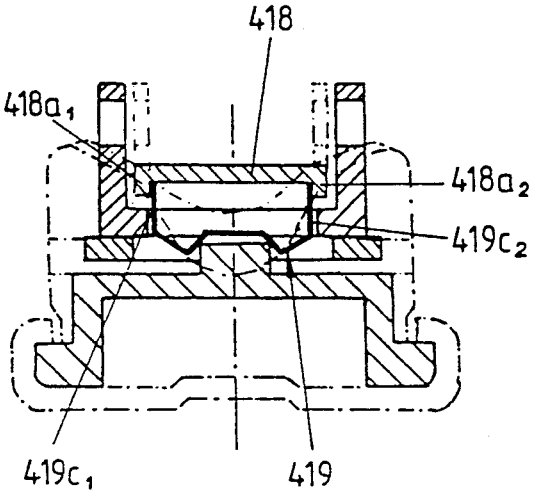

The leaf spring 419 rests in contrast to this, according to FIG. 6, with the ends of its outer legs $419c_1$, $419c_2$ only on the inner sides of the two edges $418a_1$, $418a_2$ of the insert 418, corresponding to the insert 18 in FIGS. 1 and 2.

Figure 7:
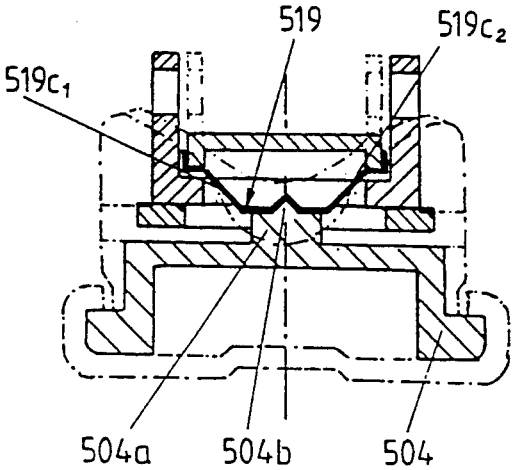
Figure 8:
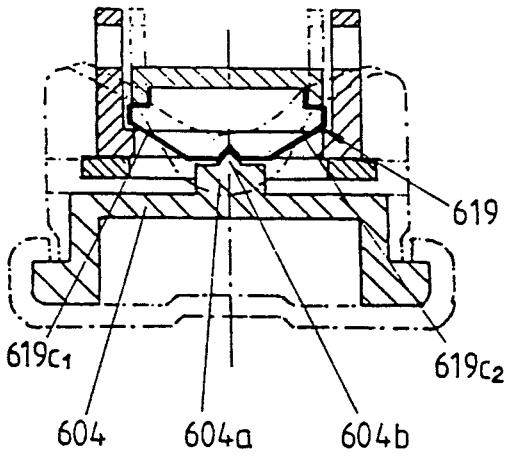
Figure 9:
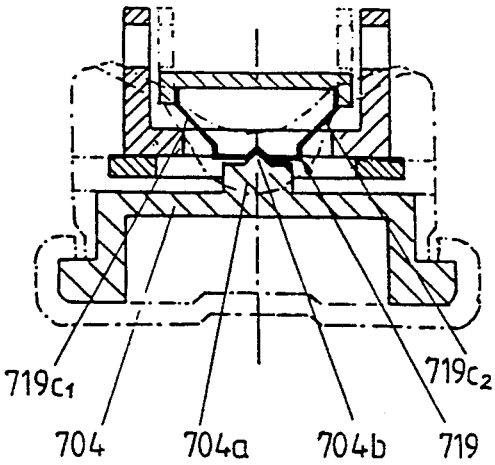
Figure 10:
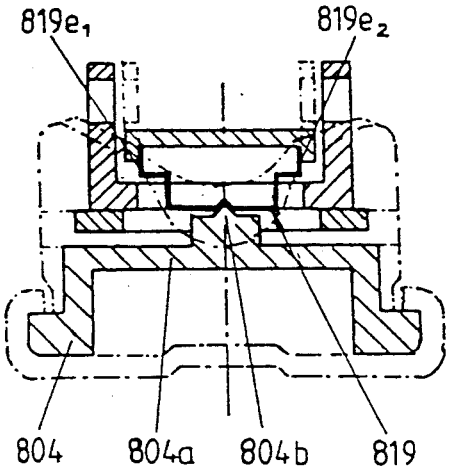

The embodiments according to FIGS. 7 to 9 differ from the ones described so far in that the projection 504*a* to 804*a* of the base plate 504 to 804, respectively, has on its upper side a rib 504*b* to 804*b* which is triangular in cross section and extends in longitudinal direction of the ski, which rib is received in the skiing position of the heel holder a corresponding notch of the leaf spring 519 to 819. The ends of the legs $519c_1$, $519c_2$ to $819c_1$, $819c_2$ are fastened in the same manner as has already been described in connection with FIGS. 2, 5, 6 and 7. However, the spring 819 according to FIG. 10 is U-shaped with the two legs $819e_1$, $819e_2$ each being provided with one outwardly directed step. The stiffness of the spring is reduced with the step.

Figure 11:
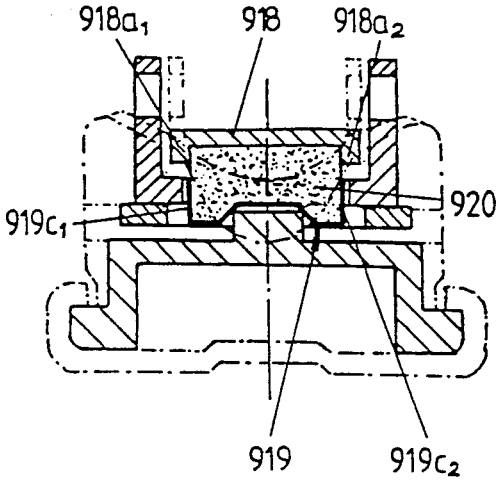

The embodiment of a leaf spring 919 illustrated in FIG. 11 is distinguished by storing a cushion 920 made of a viscous or rubber-elastic material in a cavity located between the leaf spring 919 and the insert 918, which facilitates a thinner design of the leaf spring 919. The ends of the outer legs $919c_1$, $919c_2$ rest here on the inner sides of the two edges $918a_1$, $918a_2$ of the insert 918.

Figure 12:
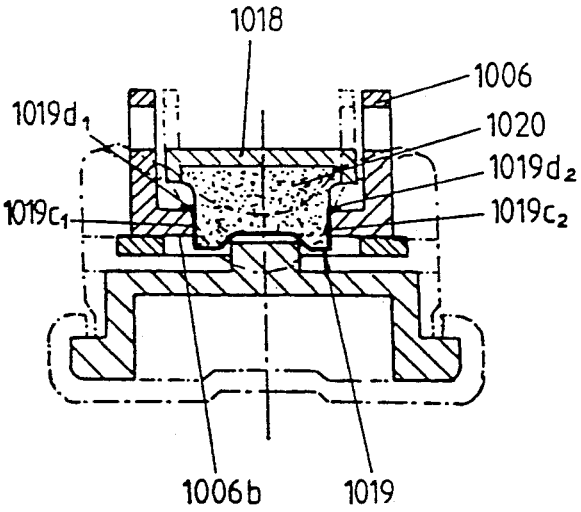

Also in the embodiment of a leaf spring 1019 according to FIG. 12, a cushion 1020 of rubber is arranged above the spring, which cushion is supported on the insert 1018. However, the leaf spring 1019 is in contrast to the preceding exemplary embodiment not fastened with the upper ends of its legs $1019c_1$, $1019c_2$ to the insert 1018, but instead the ends $1019d_1$, $1019d_2$ of the legs $1019c_1$, $1019c_2$ are bent outwardly and rest on the edge of a recess in the base 1006*b* of the bearing block 1006.

Figure 13:
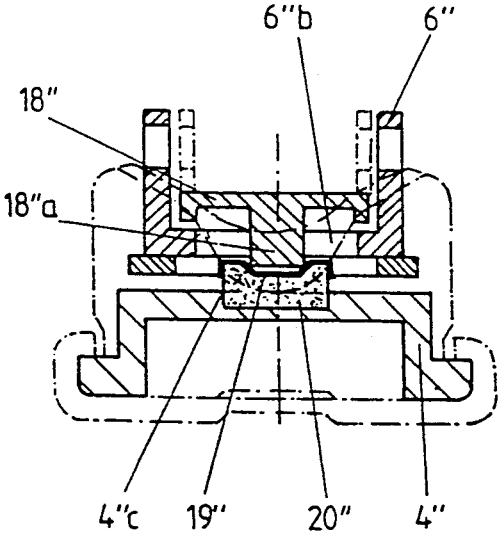

The embodiment according to FIG. 13 is distinguished by the base plate 4" in this embodiment having a recess 4"*c* extending in longitudinal direction of the base plate and being rectangular in the top view and in cross section, into which recess is inserted a cushion 20" made of a rubber-elastic material. The cushion 20" is covered by a leaf spring 19" at its upper side, which leaf spring has a trapezoidal cross section in its center area. The cushion 20" of a rubber-elastic material and the leaf spring 19" form in this embodiment together a self-contained elastic locking mechanism. The bearing block 6" has a plate-shaped insert 18" made of plastic with a downwardly directed projection 18"*a* extending in longitudinal direction of the bearing block 6" and being rectangular in cross section. The projection 18"*a* is associated with the cushion 20" in the recess 4"*c* in the base plate 4" or rather the leaf spring 19". The projection 18"*a* of the insert 18" is received, in the center position of the bearing block 6", in the center area of the leaf spring 19", which area has the aforementioned trapezoidal cross section.

The invention is not to be limited to the exemplary embodiments illustrated in the drawings and described above. Rather various modifications of the same are possible without departing from the scope of the invention. For example, it would be possible to manufacture the housing 21 of a suitable plastic instead of aluminum.

The embodiments of the invention in which an exclusive property or privilege is claimed are defined as follows:

1. In a heel holder comprising a base plate on which is arranged a bearing block pivotal laterally about a vertical axle, said bearing block having supported thereon a swivel head that is pivotal in a vertical plane about a transversely extending axle, said swivel head having a first locking element, said swivel head being held against a pivoting in the vertical plane relative to said bearing block by means of said first locking element loaded by a release spring bearing against a first locking member, said swivel head having a sole downholding means thereon and a stepping spur on a front facing side thereof, said heel holder further including a second locking element, said second locking element engaging a ski-fixed second locking member by which said bearing block is held against a pivoting in a horizontal plane, a further spring provided between said base plate and said bearing block for causing a return of said bearing block from the swung-out position into a centered position thereof, and a self-contained elastic locking mechanism, said elastic locking mechanism holding said bearing block against a lateral pivoting out from said centered position during stepping in with a ski boot, the improvement wherein at least one of said bearing block and said base plate has a projection defining at least one of said second locking element and said second locking member thereon, a longitudinal axis of said projection extending in the vertical plane, said projection being rectangular in a vertical plane cross section, with which projection is associated a recess defining an other of said at least one of said second locking element and said second locking member, said recess being provided in the other of said base plate and said bearing block, and wherein between said projection and said recess there is arranged said self-contained elastic locking mechanism continuously bearing against said projection to hold, as aforesaid, said bearing block against a lateral pivoting out from said centered position thereof.

2. The heel holder according to claim 1, wherein said bearing block includes a base and a space between a pair of walls upstanding from said base and there is provided in the space a plate-shaped insert which extends parallel to said base, said insert forming an abutment to which said self-contained elastic locking mechanism is supported, and wherein said plate-shaped insert has edges at its two longitudinal sides which project downwardly.

3. The heel holder according to claim 2, wherein said self-contained elastic locking mechanism is formed by a leaf spring, the outer legs of which are supported with their ends on said two edges of said plate-shaped insert.

4. The heel holder according to claim 1, wherein said elastic locking mechanism has an underside which is at least one of W-shaped and U-shaped in a side view thereof.

5. The heel holder according to claim 1, wherein a roof-shaped rib extending in longitudinal direction of said base plate is provided on said projection, said rib being received, in said centered position of said heel holder, in a center notch on said elastic locking mechanism.

6. The heel holder according to claim 2, wherein said space between said elastic locking mechanism and said insert is filled by a cushion, said cushion being held in place by said elastic locking mechanism.

7. The heel holder according to claim 3, wherein a roof-shaped rib extending in longitudinal direction of said base plate is provided on said projection, said rib being received, in said centered position of said heel holder, in a center notch on said elastic locking mechanism, wherein said self-contained elastic locking mechanism is formed by a leaf spring, the outer legs of which are supported with their ends on said two edges of said plate-shaped insert, and wherein said outer legs of said leaf spring are bent outwardly at their free ends and rest with these bent areas on the edge of said recess in said base of said bearing block.

8. The heel holder according to claim 1, wherein said elastic locking mechanism is secured against lifting off by means of a cross bar of a housing covering said bearing block and secured on said bearing block.

9. The heel holder according to claim 1, wherein the upper side of the base plate defines with its underside a rearwardly open acute angle ($\alpha$).

10. In a heel holder comprising a base plate on which is arranged a bearing block pivotal laterally about a vertical axle, said bearing block having supported thereon a swivel head that is pivotal in a vertical plane about a transversely extending axle, said swivel head having a first locking element, said swivel head being held against a pivoting in the vertical plane relative to said bearing block by means of said first locking element loaded by a release spring bearing against a first locking member, said swivel head having a sole downholding means thereon and a stepping spur on a front facing side thereof, said heel holder further including a second locking element, said second locking element engaging a ski-fixed second locking member by which said bearing block is held against a pivoting in a horizontal plane, a further spring provided between said base plate and said bearing block for causing a return of said bearing block from the swung-out position into a centered position thereof, and a self-contained elastic locking mechanism, said elastic locking mechanism holding said bearing block against a lateral pivoting out from said centered position during stepping in with a ski boot, the improvement wherein said bearing block has a plate-shaped insert with a downwardly directed projection extending in longitudinal direction of the bearing block and being rectangular in a vertical plane cross section thereof, with which projection is associated a recess extending in longitudinal direction of said base plate and being rectangular in a horizontal plane cross section thereof, into which recess said self-contained elastic locking mechanism in the form of a cushion of a rubber-elastic material and of a leaf spring is inserted, which latter is arranged on the upper side of the cushion and has a trapezoidal cross section in its center area, into which area is received, in a centered position of said bearing block, said projection of said insert.

11. The heel holder according to claim 10, wherein an upper side of said base plate defines with its underside a rearwardly open acute angle ($\alpha$).

* * * * *